US006659817B1

(12) United States Patent
Anderson et al.

(10) Patent No.: US 6,659,817 B1
(45) Date of Patent: Dec. 9, 2003

(54) ALIGNMENT SYSTEM FOR AN OUTBOARD MOTOR

(75) Inventors: Glenn E. Anderson, Omro, WI (US); Mark T. Lokken, Oshkosh, WI (US); David M. Schmidt, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/271,463

(22) Filed: Oct. 15, 2002

(51) Int. Cl.[7] ..... B63H 5/125
(52) U.S. Cl. ..... 440/53; 440/62; 440/55
(58) Field of Search ..... 440/53, 55, 57; 248/640–643

(56) References Cited

U.S. PATENT DOCUMENTS

| | | | | |
|---|---|---|---|---|
| 3,269,350 A | * | 8/1966 | Stibbe et al. | 440/52 |
| 3,567,164 A | | 3/1971 | Hakala | 248/4 |
| 3,693,576 A | | 9/1972 | Driscoll | |
| 3,952,986 A | | 4/1976 | Wells | 248/354 |
| 4,685,888 A | | 8/1987 | Brewer | 440/53 |
| 5,647,781 A | | 7/1997 | Johnson, Sr. | 440/53 |
| 5,752,733 A | | 5/1998 | Marshall | 294/154 |
| 5,775,669 A | | 7/1998 | Huggins et al. | 248/640 |
| 5,795,202 A | | 8/1998 | Williams | 440/113 |
| 5,888,109 A | | 3/1999 | Poll | 440/55 |
| 5,979,861 A | | 11/1999 | Weaver | 248/642 |

* cited by examiner

*Primary Examiner*—Jesus D. Sotelo
(74) *Attorney, Agent, or Firm*—William D. Lanyi

(57) ABSTRACT

First and second pliable members are each attached to an outboard motor and to a fixed location on the transom or transom bracket associated with the outboard motor. One pliable member is used on the starboard side of the outboard motor while another is used on the port side. As the outboard motor is tilted about its trim axis, the two pliable members work in coordination with each other to exert a force on the outboard motor in a direction away from any direction in which the outboard motor is rotated about its steering axis as it is being tilted about its trim axis. This coordinated action by the two pliable members aligns the outboard motor in a straight ahead position when it is tilted upward into an inoperable position for transportation.

20 Claims, 5 Drawing Sheets

ALIGNMENT SYSTEM FOR AN OUTBOARD MOTOR

BACKGROUND OF THE INVENTION

1. FIELD OF THE INVENTION

The present invention is generally related to an alignment system for an outboard motor and, more particularly, to a pair of pliant components that automatically cause an outboard motor to become aligned with a straight ahead steering position as the outboard motor is tilted about a generally horizontal axis.

2. DESCRIPTION OF THE PRIOR ART

Many different systems and devices have been developed for supporting and retaining an outboard motor in a tilted position, relative to a transom of a marine vessel, when the outboard motor is not in use. These devices and systems are generally helpful when the outboard motor is tilted upwardly during periods when the associated boat is being transported over land or when another means of propulsion is used to cause the watercraft to move on the water. In situations when an outboard motor is not in use to propel the boat, it is commonly tilted upwardly and stored in that inoperable position for extended periods of time.

U.S. Pat. No. 3,693,576, which issued to Driscoll on Dec. 26, 1972, describes an outboard motor stabilizer. An elongated outboard motor prop includes a first forked end for embracingly engaging the front side of the lower end of the upstanding propeller shaft housing of an outboard motor. It is provided with a strap means for releasably securing the propeller shaft housing in the first forked end of the prop. The second end of the prop has a mounting bracket oscillatably supported therefrom for swinging of the prop relative to the mounting bracket about an axis extending transversely of the second end of the prop. The mounting bracket is in turn oscillatably supported from a mounting plate for swinging about an axis relative to the latter disposed at right angles to the first mentioned axis and the mounting plate is provided with means for at least semi-permanent securement to the rear transverse cross member of a trailer frame. This mounting of the prop enables the latter to be used as a prop in securing an associated outboard motor in a tilted position or to be swung to an out of the way position extending along and disposed behind the rear transverse frame member of the associated boat trailer.

U.S. Pat. No. 5,775,669, which issued to Huggins et al on Jul. 7, 1998, describes an outboard motor traveling bracket. The bracket supports an outboard motor or outdrive while being transported over the road on the stem of a boat. The bracket allows the foot or housing of the outboard motor or outdrive to be placed in such a up position so that it is not in danger of coming into contact with the surface of the roadway. The bracket also prevents excessive weight on and consequential damage to the hydraulic and manual tilt and support systems of the outboard motor or outdrive being transported. The bracket hangs from the factory drilled holes in the outboard motor clamp bracket or outdrive bracket by means of a drop bar pin secured in place by quickly and easily removable click pins. When assembled, the bracket forms a rigid support between the stem of a boat and the foot or shaft housing of the motor or outdrive being transported.

U.S. Pat. No. 5,979,861, which issued to Weaver on Nov. 9, 1999, describes a pivot bracket for stowing an outboard motor on a stowed dinghy. an outboard motor stow pivot bracket is disclosed for slowing a motor in a generally vertical orientation while mounted on the transom of a dinghy which itself is swung beamwise (on beam ends) from a horizontal, in-the-water position up into a generally vertical stowed position on the back of a carrier boat such as on the stem of a pleasure craft.

U.S. Pat. No. 5,888,109, which issued to Poll on Mar. 30, 1999, describes an outboard motor support device. The device is intended for use in securing an outboard motor to a transom of a boat which comprises a tie down bracket, a support, and a tie down strap. The tie down bracket is secured to the transom of the boat while the support is rotatably mounted to the motor such that when the motor is in an up position, the support can support can rotate about its mounting point to contact and support the motor. The tie down strap then passes behind the motor and is secured to the tie down bracket. This secures the motor between the support and the tie down strap and provides additional support.

U.S. Pat. No. 5,752,733, which issued to Marshall on May 19, 1998, describes an adjustable strap assembly for raising, lowering and transporting outboard motors and similar heavy bulky objects. An adjustable strap assembly is provided for raising, lowering and transporting outboard motors and similar heavy bulky objects. The adjustable strap assembly, in its preferred embodiment, requires a handle having a central tubular portion, a single strap of nylon webbing or the like oriented in a figure-8 configuration with the material of the strap passing through the tubular central portion of the handle twice so as to form an assembly having a first strap loop on one side of the handle devoid of fasteners and a second strap loop on the opposite side of the handle formed by coupling together the first and second free ends of the strap using a suitable buckle assembly.

U.S. Pat. No. 5,795,202, which issued to Williams on Aug. 18, 1998, describes an outboard motor support device. An outboard boat motor support device is attachable between the boat transom and the outboard motor to help the outboard motor from inflicting damaging torque to the transom mounting point during trailering or water operation. The device comprises a rigid plate fixedly attached to the transom of the boat and a support member capable of being retracted within the plate or extended from the boat to engage the lower casing of the outboard motor in a tilted position, thereby maintaining the outboard motor in the tilted position during trailering.

U.S. Pat. No. 5,647,781, which issued to Johnson, Sr. on Jul. 15, 1997, describes an outboard motor support. The support is intended for preventing damage from inadvertent pivoting of the motor during trailering. It includes a pair of spring-loaded locking pins for convenient placement and removal. The support is attached to the motor and boat without making modifications thereto and handles are affixed to the spring-loaded locking pins for easy manipulation. Two embodiments of the outboard motor support are provided to accommodate the different popular types of outboard motor.

U.S. Pat. No. 4,685,888, which issued to Brewer on Aug. 11, 1987, describes an outboard motor support. A shock arm is adapted to be mounted between a trailer and the shaft of an outboard motor attached to a boat carried by the trailer. The shock arm includes a lower member rigidly affixed to the trailer frame and an upper member having a V-shape and adapted to receive the motor shaft. Between the lower and upper ends is a shock absorbing which absorbs the shock of the motor whenever the trailer hits a bump in the road. A hydroelectric tilt mechanism may be provided as a part of the motor to return the compressed shock absorber to the normal position or a spring may be included with the shock absorber to cause it to return to the normal position.

U.S. Pat. No. 3,952,986, which issued to Wells on Apr. 27, 1976, describes an outboard motor support. The support is intended for use with an outboard motor in combination with a boat trailer. The motor support is pivotably attached to the trailer and has a support swingably attached to the trailer at its lower end and Y-shaped member which receives the propeller shaft housing of the outboard motor adjacent the propeller. A strap is connected through stirrups in the distal ends of the Y, holding the motor cradled in the Y. A female telescoping member is pivoted to the boat trailer and a male telescoping member is slidably received in the female member attached to the trailer frame so that the outboard motor is held in rigid position.

U.S. Pat. No. 3,567,164, which issued to Hakala on Mar. 2, 1971, describes an outboard motor support. The support is particularly adapted for attachment to a primary outboard motor mounted on a boat transom and which has a fixed support section with a movable support section pivotally mounted thereon having means for supporting an outboard motor. The movable support section has a lever means extending forwardly toward the boat for pivotally moving the movable support section, thereby affecting vertical movement of the outboard motor into or out of the water. A latch means is also provided for holding the movable support section and the outboard motor in a selected vertical position. Spring means are also preferably provided which connect the opposite sides of the fixed support section of the outboard motor support means to the opposite end portions of the boat transom to automatically center the outboard motor mounted thereon when the steering mechanism is unattended and maintain the boat traveling along a straight course.

United States patent application Ser. No. 09/777,590 (M09494) which was filed by McCoy on Feb. 6, 2001, discloses a support bracket for an outboard motor. A support bracket for an outboard motor is provided in which a support arm is pivotally attached to a transom bracket of an outboard motor to allow it to pivot upward and be captured by a latching device which is rigidly attached either to a support structure of the outboard motor or directly to its driveshaft housing. When captured within the latching device attached to the outboard motor, the support arm prevents upward or downward movement of the outboard motor and inhibits any rotation of the outboard motor about its tilt axis. The support arm also inhibits rotation of the outboard motor about its steering axis. The support mechanism therefore prevents potential damage to the outboard motor and its support brackets when the outboard motor is stored in an upwardly tilted position and subjected to shock loads.

The patents described above are hereby expressly incorporated by reference in the description of the present invention.

When outboard motors are stored in a tilted up position, for either transportation on a boat trailer or movement from one location to another on a body of water, the support structure of the outboard motor is often subjected to shock loads. The effect of the shock loads is exacerbated when the outboard motor is also rotated about its steering axis in either a port or starboard direction when the shock load occurs. This rotation of the outboard motor away from its straight ahead steering position adversely affects the nature and magnitude of the stress to which the mounting brackets of the outboard motor are subjected. It would therefore be significantly beneficial if an inexpensive and simple system could be provided that assures that the outboard motor is aligned with a straight ahead steering position and away from either a port or starboard steering position whenever the outboard motor is tilted up about its tilt axis. It would also be significantly beneficial if the system provided for this function could automatically straighten the position of the outboard motor without additional required operator intervention.

SUMMARY OF THE INVENTION

An alignment system for an outboard motor, made in accordance with the preferred embodiment of the present invention, comprises a first pliable member attachable between a first contact location and a second contact location. The first contact location is a part of the outboard motor and is rotatable with the outboard motor about a steering axis of the outboard motor. The second contact location is not rotatable with the outboard motor about the steering axis. Preferably, the second contact location is attached to the transom of a watercraft or to a transom bracket of the outboard motor. The first and second contact locations are spaced apart by a first distance when the outboard motor is attached to a boat and disposed in an operable position with the driveshaft being in a generally vertical position. It should be understood that variations from a vertical position, when the outboard motor is in an operable position, are within the scope of the present invention regarding the definition of the first distance. The first and second contact locations are spaced apart by a second distance when the outboard motor is attached to the boat and disposed in an inoperable position with the driveshaft being tilted away from the generally vertical position. When the outboard motor is in the inoperable position, the propeller of the outboard motor is raised out of the water in which the boat is being operated. When in the operable position, the propeller of the outboard motor is disposed below the surface of the water in which the boat is operated. The second distance is greater than the first distance. The first pliable member has a first length which is greater than the first distance, but equal to or less than the second distance. A first attachment component is connected to a first portion of the first pliable member. The first attachment component is attachable to the first contact location. A second attachment component is connected to a second portion of the pliable member. The second attachment component is attachable to the second contact location.

In a particularly preferred embodiment of the present invention, a second pliable member is attachable between a third contact location and a fourth contact location. The third contact location is part of the outboard motor and is rotatable with the outboard motor about its steering axis. The fourth contact location is not rotatable with the outboard motor. The third and fourth contact locations are analogous to the first and second contact locations, but on a different side of the outboard motor. Third and fourth attachment components are provided with respect to the second pliable member and are generally analogous to the first and second attachment components.

The first and second pliable members are made of a generally inelastic material in a preferred embodiment of the present invention. The belt webbing that is commonly used in the manufacture of seat belts for automobiles is an acceptable inelastic material for use in manufacturing the first and second pliable members. It should be understood that elastic material can also be used in alternative embodiments of the present invention.

The first and third attachment components are metal rings in a preferred embodiment of the present invention. The first and third portions, respectively, of the first and second pliant members are disposed and fastened through the metal rings which can be rigidly attached to either of the transom of the boat or the transom bracket of the outboard motor. The second and fourth attachment components are metal clamps in a preferred embodiment of the present invention. The metal clamps are used to fasten the second and fourth portions, respectively, of the first and second pliant members to the second and fourth contact locations which can be located on the port and starboard sides of a swivel head structure of the outboard motor. The first, second, third, and fourth attachment components need only be sufficiently rigid to maintain their respective portions of the associated pliable members in position at the respective contact locations. In other words, the attachment components need not be metal. They merely need to be sufficiently rigid to hold the first and second pliable members in position with respect to the contact locations.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
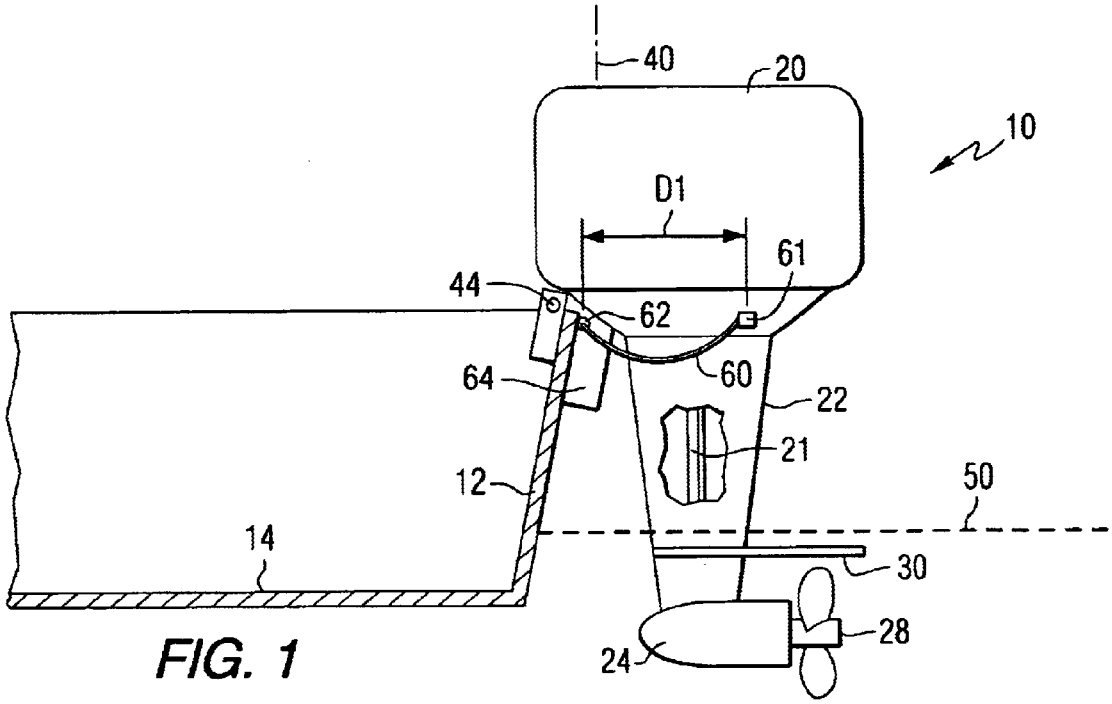
FIG. 1 is a simplified schematic representation of an outboard motor showing its port side and one of the two pliable members of the present invention.

Throughout the description of the preferred embodiment of the present invention, like components will be identified by like reference numerals.

FIG. 1 is a simplified schematic representation of the port side of an outboard motor 10 which is supported by a transom 12 of a marine vessel 14. In most applications, the outboard motor has a cowl 20 that is used to cover and protect an internal combustion engine that is supported by an adaptor plate and from which a driveshaft 21 extends downwardly, through a driveshaft housing 22, to a gearcase 24 where it is connected in torque transmitting relation with a propeller shaft on which a propeller 28 is mounted. An anti ventilation plate 30 is shown above the gearcase 24 and propeller 28. It should be understood that the outboard motor 10 in FIG. 1 is represented in a simplified schematic manner to illustrate the basic concept of the present invention. The precise configuration of the outboard motor 10 is not limiting to the present invention.

Figure 2:
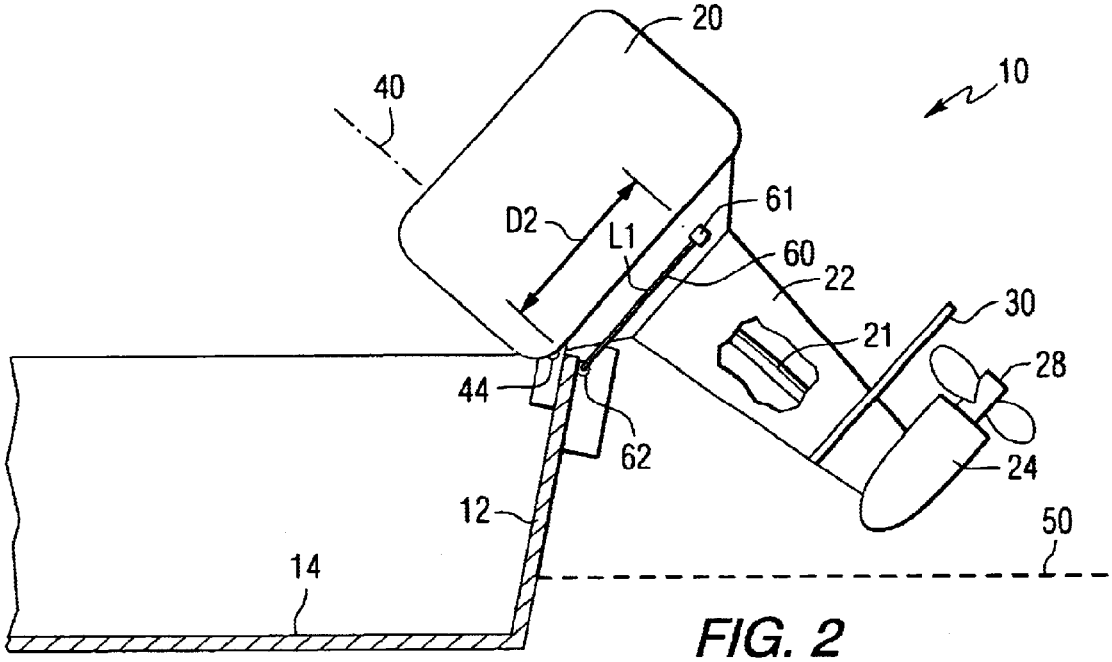
FIG. 2 is similar to FIG. 1 but with the outboard motor tilted upwardly into an inoperable position.

In a typical application of an outboard motor, the outboard motor 10 is supported for rotation about a generally vertical steering axis 40 and for rotation about a generally horizontal tilt axis 44. FIG. 2 is generally similar to FIG. 1, but with the outboard motor 10 tilted upward about its tilt axis 44.

With continued reference to FIGS. 1 and 2, the position of the outboard motor 10 in FIG. 1 will be considered as the operable position in the description of the preferred embodiment of the present invention. The position of the outboard motor 10 shown in FIG. 2 will be considered as the inoperable position. When in the operable position shown in FIG. 1, the propeller 28 is disposed in the water with at least a portion of the propeller 28 below the level 50 of the body of water in which the boat 14 is operated and with the driveshaft 21 in a generally vertical position. When in the inoperable position, as shown in FIG. 2, the outboard motor 10 is tilted about the tilt axis 44 to raise the propeller 28 above the surface 50 of the body of water in which the boat 14 is operated. When in the inoperable position, the driveshaft 21 is tilted away from the generally vertical position shown in FIG. 1. In many applications of outboard motors, the driveshaft 21 is generally parallel to the steering axis 40. The driveshaft 21, which is contained within the driveshaft housing 22, extends between the crankshaft of the internal combustion engine under the cowl 20 and a forward end of the propeller shaft, within the gearcase housing 24, to which the propeller 28 is attached.

With continued reference to FIGS. 1 and 2, a first pliable member 60 is attachable between a first contact location 61 and a second contact location 62. The first contact location 61 is attached to the outboard motor 10 and is rotatable with the outboard motor 10 about the steering axis 40. The second contact location 62 is not rotatable with the outboard motor 10 about the steering axis 40. In a preferred embodiment of the present invention, the second contact location 62 can be attached directly to the transom 12, formed as a part of the transom bracket 64, or shaped to be retained between the transom 12 and the transom bracket 64. The first and second contact locations, 61 and 62, are spaced apart by a first distance D1 when the outboard motor 10 is attached to a boat 14 and disposed in an operable position, such as that shown in FIG. 1, with the driveshaft 21 being in a generally vertical position. The first and second contact locations, 61 and 62, are spaced apart by a second distance D2, as shown in FIG. 2, when the outboard motor 10 is attached to the boat 14 and disposed in an inoperable position with the driveshaft 21 being tilted away from the generally vertical position shown in FIG. 1. The first pliable member 60 is located on the port side of the outboard motor 10, as illustrated in FIGS. 1 and 2. It should be understood that a similarly configured second pliable member is similarly attached to third and fourth contact locations on the starboard side of the outboard motor 10. The third and fourth and contact locations are situated similarly to the first and second contact locations, 61 and 62. When the outboard motor 10 is tilted into the inoperable position shown in FIG. 2, both the first and second pliable members are extended into a generally straight configuration. This can be compared to the relaxed condition of the first pliable member 60 illustrated in FIG. 1. Although the starboard side of the outboard motor 10 is not shown in FIGS. 1 and 2, it should be understood that the first and second pliable members are intended to be shaped similarly to each other and attached in a similar manner on opposite sides of the outboard motor.

Figure 3:
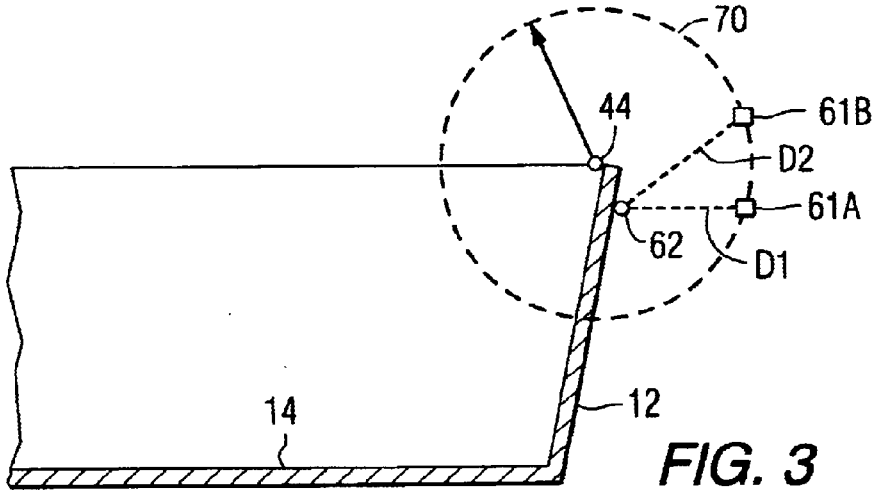
FIG. 3 is a schematic representation showing the relevant geometry of movement of various locations of the present invention.

In order to more clearly understand the operation of the present invention, FIG. 3 shows the relative positions of the tilt axis 44 and the first and second contact locations, 61 and 62. The first contact location is shown in two different positions which are identified by reference numerals 61A and 61B. Since the first contact location 61 rotates with the outboard motor 10 about the tilt axis 44, all potential positions of the first contact location must lie on the circle 70 which defines all the positions of equal distance from the tilt axis 44. The first distance D1, as described above, is the distance between the first and second contact locations when the outboard motor is in the operable position illustrated in FIG. 1. The second distance D2 is the distance between the first and second contact locations, 61 and 62, when the outboard motor 10 is tilted upwardly into an inoperable position as illustrated in FIG. 2. The second distance D1 is greater than the first distance D1. The first pliable member has a first length L1 which is greater than the first distance D1 but less than or equal to the second distance D2.

With reference to FIGS. 1–3, it can be seen that the second contact location 62 is not coincident with the tilt axis 44. As a result, rotation of the first contact location 61 about the tilt axis 44, in conjunction with the outboard motor 10, will change the distance between the first and second contact locations, 61 and 62, from D1 to D2. When the outboard motor 10 is in the operable position shown in FIG. 1, the first pliable member 60 is in a relaxed condition and not stretched to a taut position.

When the outboard motor 10 is rotated upwardly into the inoperable position shown in FIG. 2, the distance between the first and second contact locations, 61 and 62, increases to that which is generally equal to the length L1 of the first pliable member 60. Since the first length L1 is equal to or less than the second distance D2, the first pliable member 60 is stretched to a taut condition.

It should be understood that although only the first pliable member 60, which is located on the port side of the outboard motor 10, has been described in conjunction with FIGS. 1–3, the second pliable member is similarly shaped and connected, but on the starboard side of the outboard motor. Both the first and second pliable members operate similarly and perform similar functions in coordination with each other.

In operation, the first and second pliable members are extended from the relaxed positions shown in FIG. 1 to the taut position shown in FIG. 2 as the outboard motor 10 is tilted upwardly from the operable position of FIG. 1 to the inoperable position of FIG. 2. If the outboard motor 10 is leaning in either a starboard or port direction because of a partial rotation about the steering axis 40, the pliable member on the opposite side of the outboard motor 10 will become taut, prior to the other pliable member, because of the partially rotated position of the outboard motor about its steering axis 40. That pliable member will exert a force on the outboard motor when that pliable member reaches its extended length. That force will automatically cause the outboard motor 10 to rotate about its steering axis 40 toward a more straight ahead steering position. Eventually, when the outboard motor 10 is fully tilted about its tilt axis 44, both pliable members will be stretched to their taut positions and the outboard motor 10 will be aligned in a straight ahead position. This alignment occurs naturally as the outboard motor 10 is tilted or trimmed upwardly from the operable to the inoperable positions without additional involvement of the operator of the marine vessel. The two pliable members work in conjunction with each other to align the outboard motor 10 regardless of where the outboard motor was originally positioned prior to the tilting procedure.

If the boat 14 is moved while the outboard motor 10 is in the upwardly tilted position shown in FIG. 2, the aligned position of the outboard motor will lessen the potentially damaging stresses that would otherwise be caused by the outboard motor being rotated about its steering axis 40 in either a port or starboard direction. As a result, the stresses on the brackets that support the outboard motor 10 are reduced from what they would otherwise be. This is particularly important if the outboard motor support structure is subjected to impact loads, either while the boat 14 is being transported or while the operator of the marine vessel moves the boat 14 from one fishing position to another.

Figure 4:
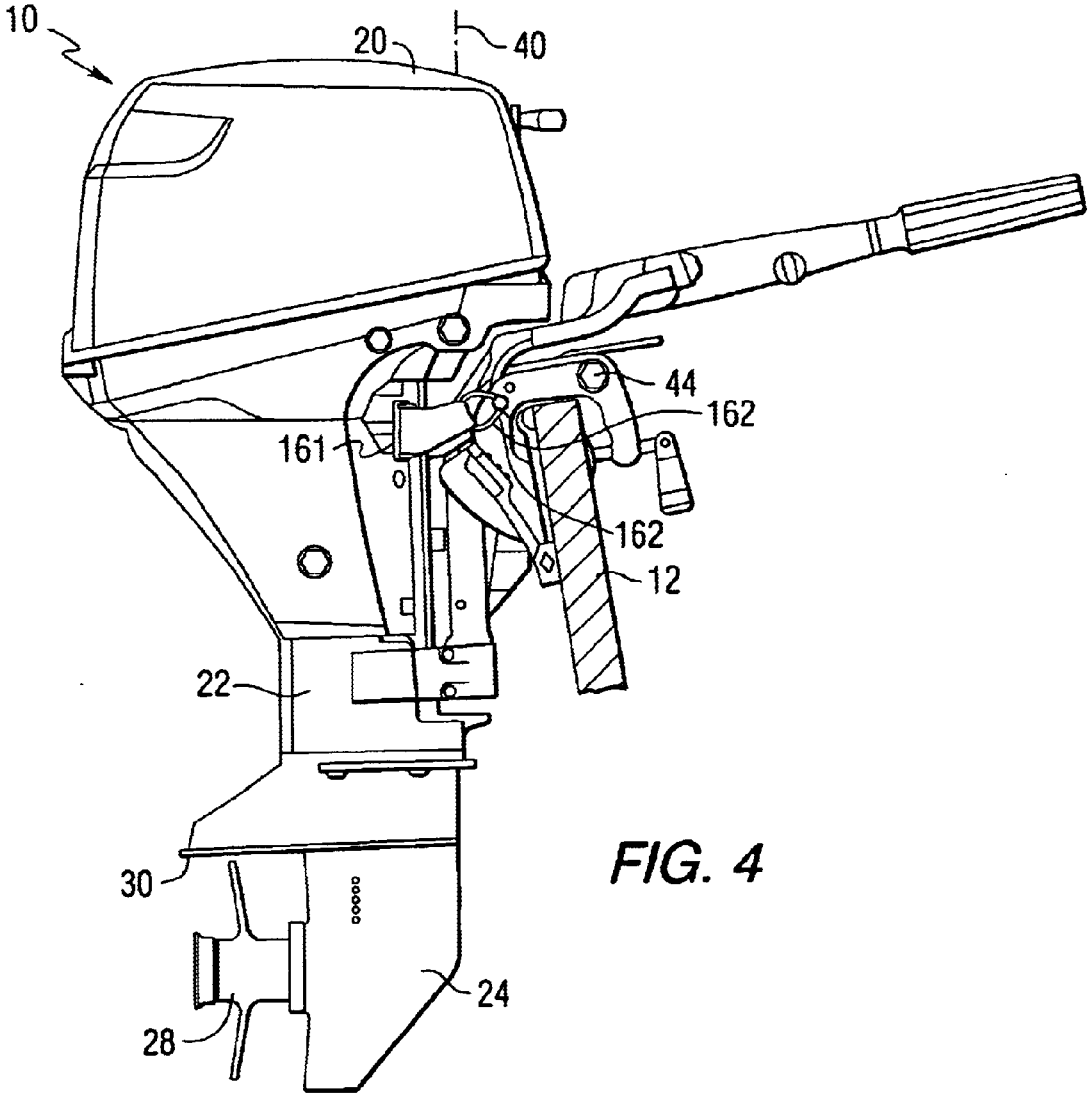
FIG. 4 shows the starboard side of an outboard motor in an operable position with a pliable member disposed in a relaxed state.
Figure 5:
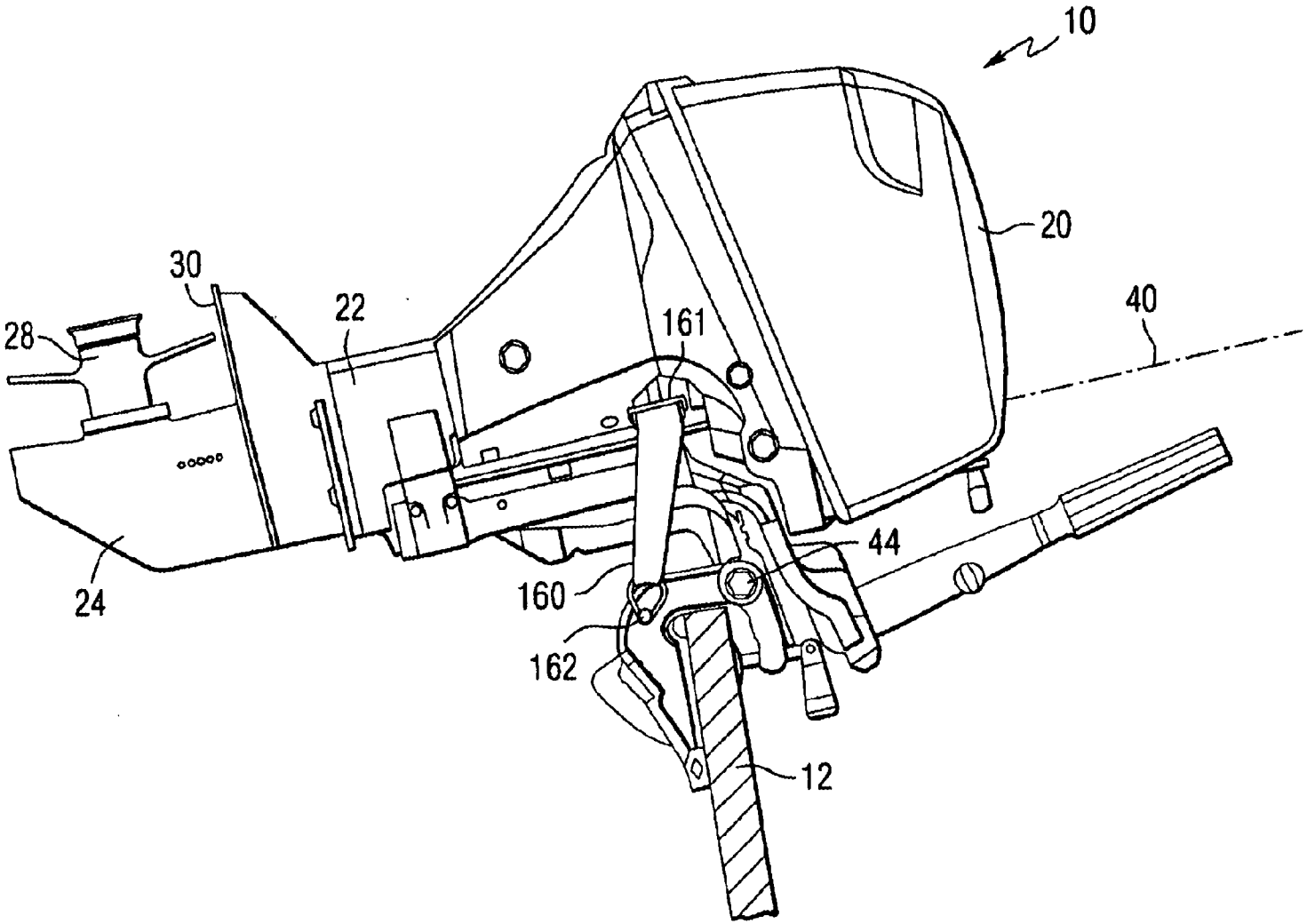
FIG. 5 shows the outboard motor of FIG. 4, but with the outboard motor tilted upwardly into an inoperable position with the starboard pliable member stretched to a taut position.

FIGS. 4 and 5 show the starboard side of the outboard motor 10 in views that are more detailed than those shown in FIGS. 1 and 2. The second pliable member 160 is attachable between a third contact location 161 and a fourth contact location 162. The third contact location 161 is attached to the outboard motor 10 (e.g. a swivel head) and is rotatable with the outboard motor about the steering axis 40. The fourth contact location 162 is not rotatable with the outboard motor about the steering axis. In all substantive respects, the first pliable member 60 and the second pliable member 160 are generally identical. Similarly, the first and third contact locations, 61 and 161, and the second and fourth contact locations, 62 and 162, are generally similar in structure, location, and function to each other. FIG. 4 shows the outboard motor in its operable position while FIG. 5 shown the outboard 10 in the inoperable position with the driveshaft (not shown in FIGS. 4 and 5) being tilted away from its generally vertical position that it occupies when the outboard motor 10 is in the operable position shown in FIG. 4.

Figure 6:
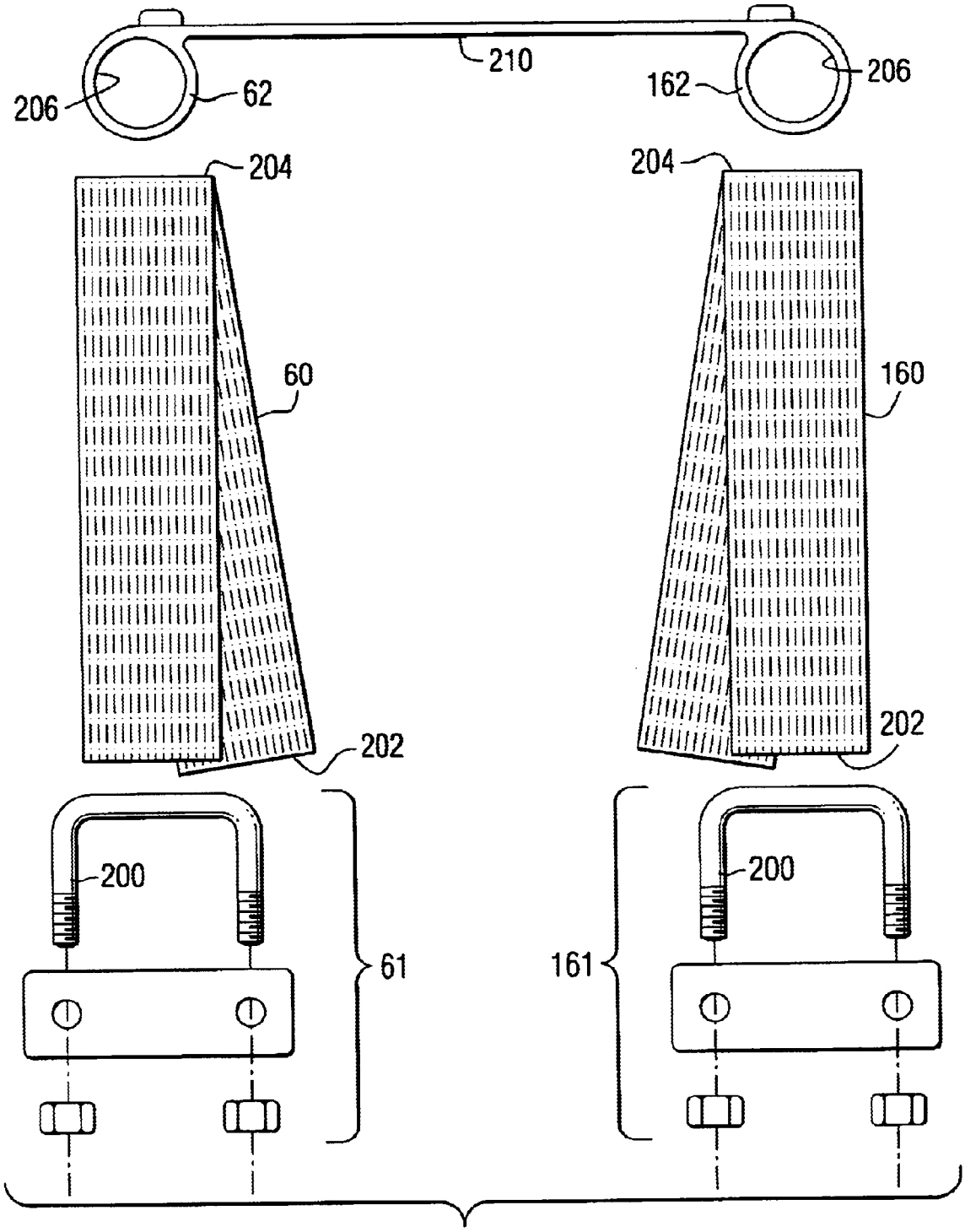
FIG. 6 shows the first and second pliable members with associated attachment components.

FIG. 6 shows the pliable members, 60 or 160, with their first and second, and third and fourth, respectively, attachment components connectable with them. It should be understood that many different types of attachment components can be used to connect the first 60 and second 160 pliable members to their respective contact locations. Any suitable attachment components can be used as long as the first and second pliable members are held in place at their respective ends so that the outboard motor 10 is aligned dynamically when it is tilted upwardly about the horizontal tilt axis 44.

In the particular embodiment shown in FIG. 6, the first attachment component is a clamp-like device 200 that allows an end 202 of the pliable member to be attached to a portion of the outboard motor 10, such as the swivel head of the outboard motor. The other end 204 of the pliable members can be looped through a ring-like portion 206 of the second attachment component 210. It should be understood that many types of connection devices can be used to hold the respective ends of the first and second pliable members, 60 and 160, at their respective attachment locations.

Figure 7:
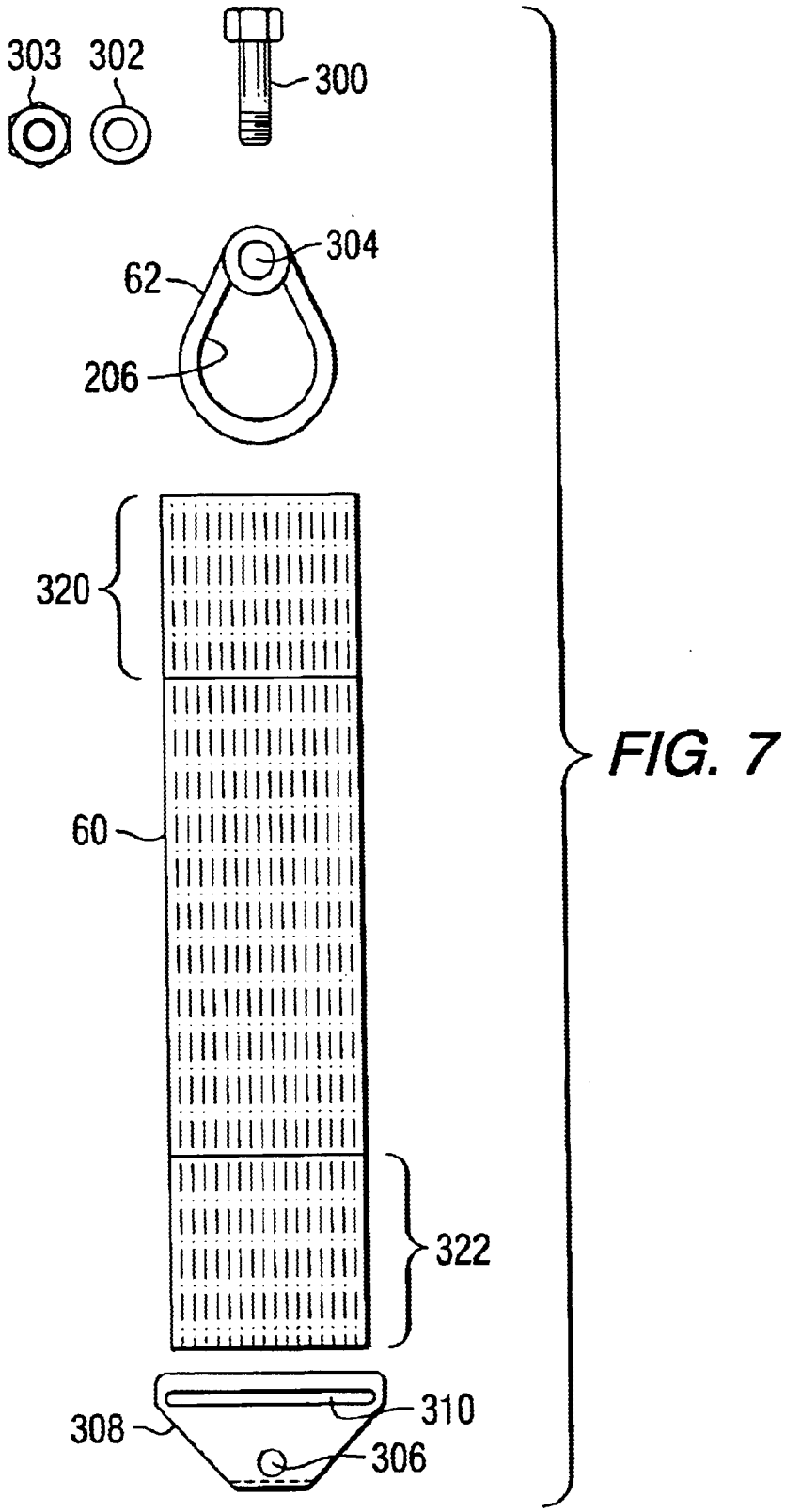
FIG. 7 shows a particularly preferred embodiment of the pliable member and attachment components of the present invention.

FIG. 7 shows a particularly preferred embodiment of the present invention that is slightly different from the embodiment shown in FIG. 6. A first pliable member 60 is shown. It should be understood that an identical second pliable member 160 would be used on an opposite side of the outboard motor, as discussed above.

The first attachment component 62 is attachable to a transom of a boat, by the use of the bolt 300, the washer 302, and the nut 304. The ring-like portion 206 is shaped to retain a first loop 320. A metallic device 308 has a slot 310 formed to retain a second loop 322 of the pliable member. The metallic device 308 can be attached to the outboard motor by inserting a fastener through hole 306.

The embodiment shown in FIG. 7, employs loops, 320 and 322, that are formed by folding the belt webbing material of the pliable member over on itself and sewing the overlapping portions together, in a manner generally known to those skilled in the art.

With reference to FIGS. 1–7, the present invention provides first and second pliable members, 60 and 160, which are attached between a location on the outboard motor 10 (e.g. a swivel head) which is rotatable with the outboard motor 10 about its steering axis 40 and a location, typically attached to the transom or transom bracket, which is not rotatable with the outboard motor 10 about the steering axis 40. These contact locations on the outboard motor and the transom are spaced apart by a first distance D1 when the outboard motor 10 is attached to a boat 14 and disposed in an operable position with its driveshaft 21 in a generally vertical position. The two contact locations are spaced apart by a second distance D2 when the outboard motor 10 is attached to the boat 14 and disposed in an inoperable position with the driveshaft 21 being tilted upward about its tilt axis 44 away from the generally vertical position. The second distance is greater than the first distance and the length of each pliable member is generally greater than the first distance, but less than or equal to the second distance. The first and second pliable members, 60 and 160, can be inelastic (e.g. belt webbing as used in seat belts) or, alternatively, elastic but sufficiently rigid to exert an aligning force on the outboard motor. The first and second pliable members of the present invention are generally identical to each other, but used on port and starboard sides of the outboard motor 10.

Although the present invention has been described in particular detail and illustrated to show a preferred embodiment, it should be understood that alternative embodiments are also within its scope. The inelasticity or elasticity of the first and second pliable members are not limiting to the present invention. Similarly, the precise type of attachment component used to attach the ends of the first and second pliable members to the transom or transom bracket and to the outboard motor are not limiting to the present invention.

We claim:

1. An alignment system for an outboard motor, comprising:

a first pliable member attachable between a first contact location and a second contact location, said first contact location being a part of said outboard motor and being rotatable with said outboard motor about a steering axis of said outboard motor, said second contact location not being rotatable with said outboard motor about said steering axis of said outboard motor, said first and second contact locations being spaced apart by a first distance when said outboard motor is attached to a boat and disposed in an operable position with a drive shaft of said outboard motor being in a generally vertical position, said first and second contact locations being spaced apart by a second distance when said outboard motor is attached to said boat and disposed in an inoperable position with said drive shaft being tilted away from said generally vertical position, said second distance being greater than said first distance, said first pliable member having a first length which is greater than said first distance, said second distance being at least equal to said first length of said first pliable member;

a first attachment component connected to a first portion of said first pliable member, said first attachment component being attachable to said first contact location;

a second attachment component connected to a second portion of said pliable member, said second attachment component being attachable to said second contact location;

a second pliable member attachable between a third contact location and a fourth contact location, said third contact location being a part of said outboard motor and being rotatable with said outboard motor about said steering axis of said outboard motor, said fourth contact location not being rotatable with said outboard motor about said steering axis of said outboard motor, said third and fourth contact locations being spaced apart by a third distance when said outboard motor is attached to said boat and disposed in an operable position with said drive shaft being in a generally vertical position, said third and fourth contact locations being spaced apart by a fourth distance when said outboard motor is attached to said boat and disposed in an inoperable position with said drive shaft being tilted away from said generally vertical position, said fourth distance being greater than said third distance, said second pliable member having a second length which is greater than said third distance, said fourth distance being at least equal to said second length of said second pliable member; and a third attachment component connected to a third portion of said second pliable member, said third attachment component being attachable to said third contact location; and a fourth attachment component connected to a fourth portion of said pliable member, said fourth attachment component being attachable to said fourth contact location.

2. The alignment system of claim 1, wherein:

said first and second pliable members are made of a generally inelastic material.

3. The alignment system of claim 1, wherein:

said first and second pliable members are made of belt webbing.

4. The alignment system of claim 1, wherein:

said first pliable member is attached between said first and second contact locations; and said second pliable member is attached between said third and fourth contact locations.

5. The alignment system of claim 1, wherein:

said first and third attachment components are metal rings through which said first and third portions, respectively, of said first and second pliable members are disposed and fastened; and said second and fourth attachment components are metal clamps used to fasten said second and fourth portions, respectively, of said first and second pliable members to said second and fourth contact locations.

6. An alignment system for a marine propulsion device, comprising:

a first pliable member attachable between a first contact location and a second contact location, said first contact location being a part of said marine propulsion device and being rotatable with said marine propulsion device about a steering axis of said marine propulsion device, said second contact location not being rotatable with said marine propulsion device about said steering axis of said marine propulsion device, said first and second contact locations being spaced apart by a first distance when said marine propulsion device is attached to a boat and disposed in an operable position with a drive shaft of said marine propulsion device being in a generally vertical position, said first and second contact locations being spaced apart by a second distance when said marine propulsion device is attached to said boat and disposed in an inoperable position with said drive shaft being tilted away from said generally vertical position, said second distance being greater than said first distance, said first pliable member having a first length which is greater than said first distance, said second distance being at least equal to said first length of said first pliable member;

a first attachment component connected to a first portion of said first pliable member, said first attachment component being attachable to said first contact location;

a second attachment component connected to a second portion of said pliable member, said second attachment component being attachable to said second contact location;

a second pliable member attachable between a third contact location and a fourth contact location, said third contact location being a part of said marine propulsion device and being rotatable with said marine propulsion device about said steering axis of said marine propulsion device, said fourth contact location not being rotatable with said marine propulsion device about said steering axis of said marine propulsion device, said third and fourth contact locations being spaced apart by a third distance when said marine propulsion device is attached to said boat and disposed in an operable position with said drive shaft being in a generally vertical position, said third and fourth contact locations being spaced apart by a fourth distance when said marine propulsion device is attached to said boat and disposed in an inoperable position with said drive shaft being tilted away from said generally vertical position, said fourth distance being greater than said third distance, said second pliable member having a second length which is greater than said third distance, said fourth distance being at least equal to said second length of said second pliable member; and a third attachment component connected to a third portion of said second pliable member, said third attachment component being attachable to said third contact location; and a fourth attachment component connected to a fourth portion of said pliable member, said fourth attachment component being attachable to said fourth contact location.

7. The alignment system of claim 6, wherein:

said first and second pliable members are made of a generally inelastic material.

8. The alignment system of claim 6, wherein:

said first and second pliable members are made of a woven fabric.

9. The alignment system of claim 8, wherein:

said woven material is belt webbing.

10. The alignment system of claim 6, further comprising:

said marine propulsion device.

11. The alignment system of claim 10, wherein:

said first pliable member is attached between said first and second contact locations; and said second pliable member is attached between said third and fourth contact locations.

12. The alignment system of claim 10, wherein:

said marine propulsion device is an outboard motor.

13. The alignment system of claim 6, wherein:

said first length is generally equal to said second length.

14. The alignment system of claim 6, wherein:

said first and third attachment components are metal rings through which said first and third portions, respectively, of said first and second pliable members are disposed and fastened.

15. The alignment system of claim 6, wherein:

said second and fourth attachment components are metal clamps used to fasten said second and fourth portions, respectively, of said first and second pliable members to said second and fourth contact locations.

16. The alignment system of claim 6, wherein:

said second and fourth contact locations are located on a swivel head of said marine propulsion device.

17. An alignment system for a outboard motor, comprising:

an outboard motor;

a first pliable strap attached between a first contact location and a second contact location, said first contact location being a part of said outboard motor and being rotatable with said outboard motor about a steering axis of said outboard motor, said second contact location not being rotatable with said outboard motor about said steering axis of said outboard motor, said first and second contact locations being spaced apart by a first distance when said outboard motor is attached to a boat and disposed in an operable position with a drive shaft of said outboard motor being in a generally vertical position, said first and second contact locations being spaced apart by a second distance when said outboard motor is attached to said boat and disposed in an inoperable position with said drive shaft being tilted away from said generally vertical position, said second distance being greater than said first distance, said first pliable strap having a first length which is greater than said first distance, said second distance being at least equal to said first length of said first pliable strap;

a first attachment component connected to a first portion of said first pliable strap, said first attachment component being attachable to said first contact location;

a second attachment component connected to a second portion of said pliable member, said second attachment component being attachable to said second contact location;

a second pliable strap attached between a third contact location and a fourth contact location, said third contact location being a part of said outboard motor and being rotatable with said outboard motor about said steering axis of said outboard motor, said fourth contact location not being rotatable with said outboard motor about said steering axis of said outboard motor, said third and fourth contact locations being spaced apart by a third distance when said outboard motor is attached to said boat and disposed in an operable position with said drive shaft being in a generally vertical position, said third and fourth contact locations being spaced apart by a fourth distance when said outboard motor is attached to said boat and disposed in an inoperable position with said drive shaft being tilted away from said generally vertical position, said fourth distance being greater than said third distance, said second pliable strap having a second length which is greater than said third distance, said fourth distance being at least equal to said second length of said second pliable strap; and a third attachment component connected to a third portion of said second pliable strap, said third attachment component being attachable to said third contact location; and a fourth attachment component connected to a fourth portion of said pliable member, said fourth attachment component being attachable to said fourth contact location.

18. The alignment system of claim 17, wherein:

said first and second pliable straps are made of a generally inelastic material.

19. The alignment system of claim 18, wherein:

said first and third attachment components are metal rings through which said first and third portions, respectively, of said first and second pliable members are disposed and fastened; and said second and fourth attachment components are metal clamps used to fasten said second and fourth portions, respectively, of said first and second pliable members to said second and fourth contact locations.

20. The alignment system of claim 18, wherein:

said second and fourth contact locations are located on a swivel head of said outboard motor.

* * * * *